United States Patent [19]

Komaki

[11] 4,050,864

[45] Sept. 27, 1977

[54] APPARATUS FOR MANUFACTURING CONCRETE PANELS WITH SURFACE PATTERN DECORATIONS

[76] Inventor: Saiji Komaki, No. 1, Nagayoshi-cho, Kagoshima, Kagoshima, Japan

[21] Appl. No.: 635,335

[22] Filed: Nov. 26, 1975

[30] Foreign Application Priority Data

Sept. 3, 1975 Japan ..... 50-106055

[51] Int. Cl.[2] ..... B28B 13/02

[52] U.S. Cl. ..... 425/134; 222/145; 425/130; 425/204; 425/209; 425/449; 366/16

[58] Field of Search ..... 425/130, 134, 200, 204, 425/209, 261, 449; 222/145; 259/164–165, 178 R; 41/100, 131, 234

[56] References Cited

U.S. PATENT DOCUMENTS

| | | | |
|---|---|---|---|
| 806,923 | 12/1905 | Sandstrom | 425/449 |
| 2,533,852 | 12/1950 | Tietig | 259/165 |
| 3,296,675 | 1/1967 | Filangeri | 425/449 |
| 3,425,105 | 2/1969 | Gulde | 425/130 |
| 3,497,580 | 2/1970 | Taylor-Smith | 425/130 |
| 3,606,093 | 9/1971 | Morse et al. | 222/145 |
| 3,887,315 | 6/1975 | Phillips | 425/209 |
| 3,904,723 | 9/1975 | Prince | 425/200 |
| 3,942,772 | 3/1976 | Smith | 259/165 |

FOREIGN PATENT DOCUMENTS

| | | | |
|---|---|---|---|
| 691,186 | 7/1964 | Canada | 222/145 |

*Primary Examiner*—Francis S. Husar
*Assistant Examiner*—John McQuade
*Attorney, Agent, or Firm*—Armstrong, Nikaido & Marmelstein

[57] ABSTRACT

An apparatus for manufacturing concrete panels with surface decoration patterns thereon said surface decoration patterns being formed by finishing material containing color cement or pigments or other coloring materials. The apparatus comprises a mortar hopper having a mortar outlet opening and a mortar shoot extending downward from beneath the outlet opening of the hopper. A molding surface is positioned below the mortar shoot and the mortar shoot extends to the molding surface. Color mortar containers are disposed above the mortar shoot to discharge color mortar materials contained therein. A mixing means incompletely mixes the mortar with the color mortar materials on the mortar shoot, a mixed mortar inverting descent guide plate is connected to the lower end of the mortar shoot and a vibrator is attached to the mortar shoot. The mortar layer which is obtained with color patterns produced through the incomplete mixing carried out by the mixing means is laid on the molding surface by the relative movement between the mixed mortar inverting descent guide plate and the molding surface.

7 Claims, 12 Drawing Figures

APPARATUS FOR MANUFACTURING CONCRETE PANELS WITH SURFACE PATTERN DECORATIONS

BACKGROUND OF THE INVENTION

This invention relates to an apparatus for manufacturing concrete panels which are decorated with surface patterns suitable for use as interior or exterior facings, walls or floorings of buildings, etc. and more particularly to an apparatus wherein an arbitrary pattern is drawn on the surface of a molding box or the like with a surface finishing material which contains colored cement or cement mixed with coloring materials or pigments and, on the pattern layer, there is formed the main body of a concrete panel with or without a binding mortar layer disposed between the pattern layer and the main body of the concrete panel.

According to what is generally practiced, concrete panels having surface patterns are prepared by drawing patterns with white and color mortar materials on a molding box or the like and then by placing concrete thereon. However, the conventional method has been carried out by manually preparing such products one after another as it is not applicable to mass production. Such a method is therefore disadvantageous for industrial applications.

SUMMARY OF THE INVENTION

The present invention has been conceived to obviate such a disadvantage of the conventional method by providing an apparatus that permits the mass production of concrete panels decorated with surface patterns through mechanized processes.

The first object of this invention is to provide surface patterns by feeding a white mortar along a mortar shoot which is provided with a vibrator to facilitate its descent in a layer of a given width and, during such descent of the white mortar, by adding one or more colors of mortar as desired to the surface of the downward flow of the white mortar to depict desired patterns thereon.

The second object of this invention is to provide means for controlling such patterns by controlling the amount of the color mortar materials which are added to the downward flow of the white mortar layer.

The third object of this invention is to provide mixing devices of various types for incompletely mixing the colored mortar materials with the white one in such a manner that various color patterns can be obtained according to the mixing mode and conditions selected.

The fourth object of this invention is to provide means for inverting upside down the incompletely mixed layer which has a colored surface pattern depicted with white and colored mortar materials by a mixed mortar inverting descent guide plate which is formed, for example, with a flexible rubber material in a J sectional shape and which is connected to the lower end of the shoot so that the downward flow of the incompletely mixed mortar layer can be inverted upside down in such a way as to continuously move on with its surface in contact with the curved lower end of the guide plate and further onto a molding surface.

As apparent from the foregoing description of objects, in accordance with this invention, an incomplete mixture of white mortar and color mortar materials is first prepared on a mortar shoot to depict colored patterns; then the downward flow of the mortar layer is inverted and continuously guided onto molding box surface one after another without deforming the depicted patterns. Such arrangement permits the control of the depiction of patterns and the continuous and speedy manufacture of surface decorated concrete panels.

With the surface decorated mortar layer placed on a molding box surface in an upside-down condition as described above, concrete is poured thereon, normally through a binding layer of mortar, to obtain a desired surface decorated panel of concrete. Furthermore, the concrete pouring process may be replaced with the use of a prefabricated internal portion of a reinforced concrete panel or a reinforced light weight concrete panel excluding its frame portion or may be replaced with such a frame portion.

Furthermore, the above-mentioned white mortar and color mortar may be prepared with water glass, synthetic resins, cement dispersed materials, aggregate or the like mixed therein for use as a surface finishing material.

BRIEF DESCRIPTION OF THE DRAWINGS:

In the accompanying drawings.

DETAILED DESCRIPTION OF THE PREFERRED EMBODIMENTS

Figure 1:
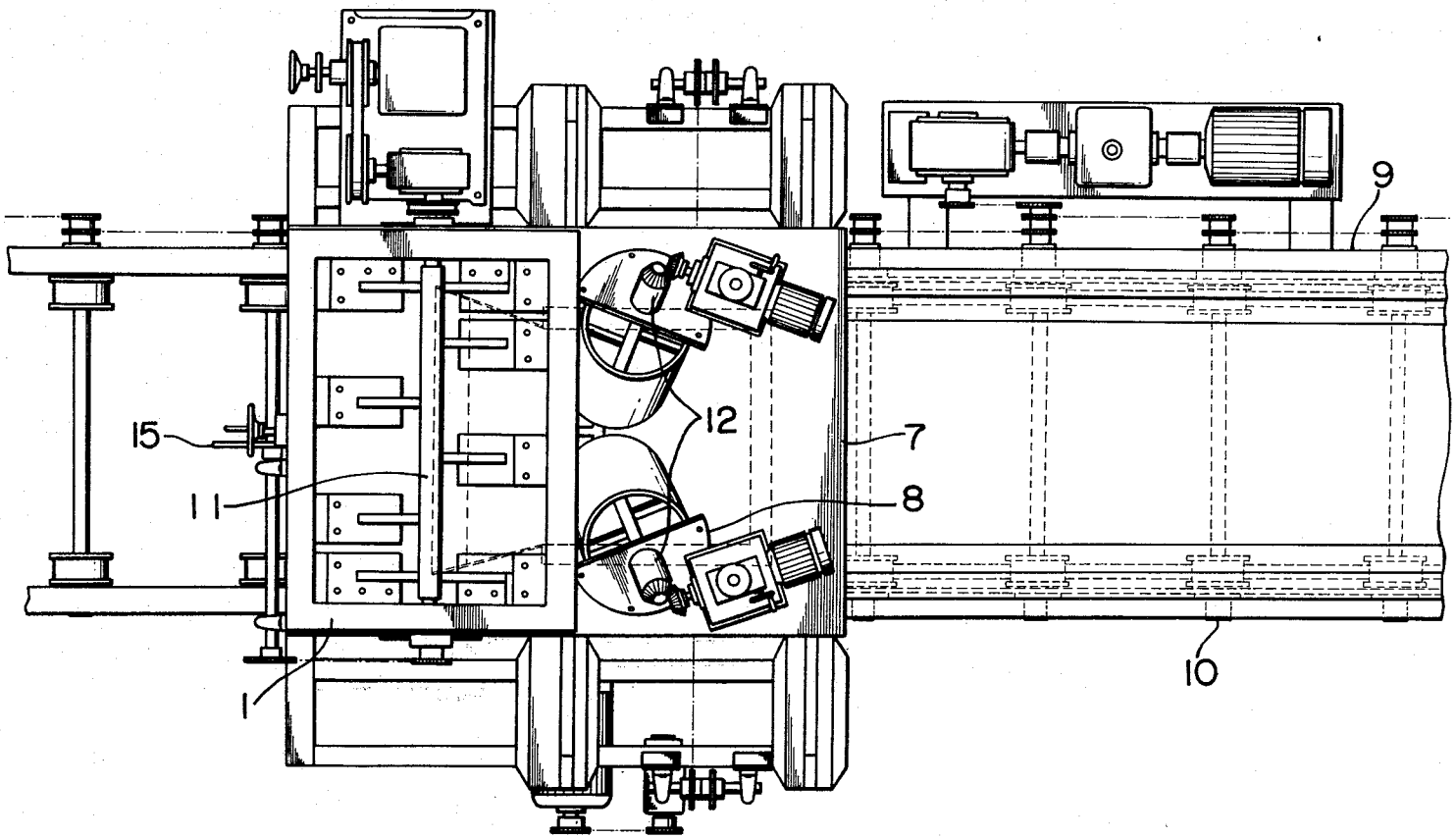
FIGS. 1 and 2 are a plan view and a sectional view respectively illustrating a first embodiment of this invention.
Figure 2:
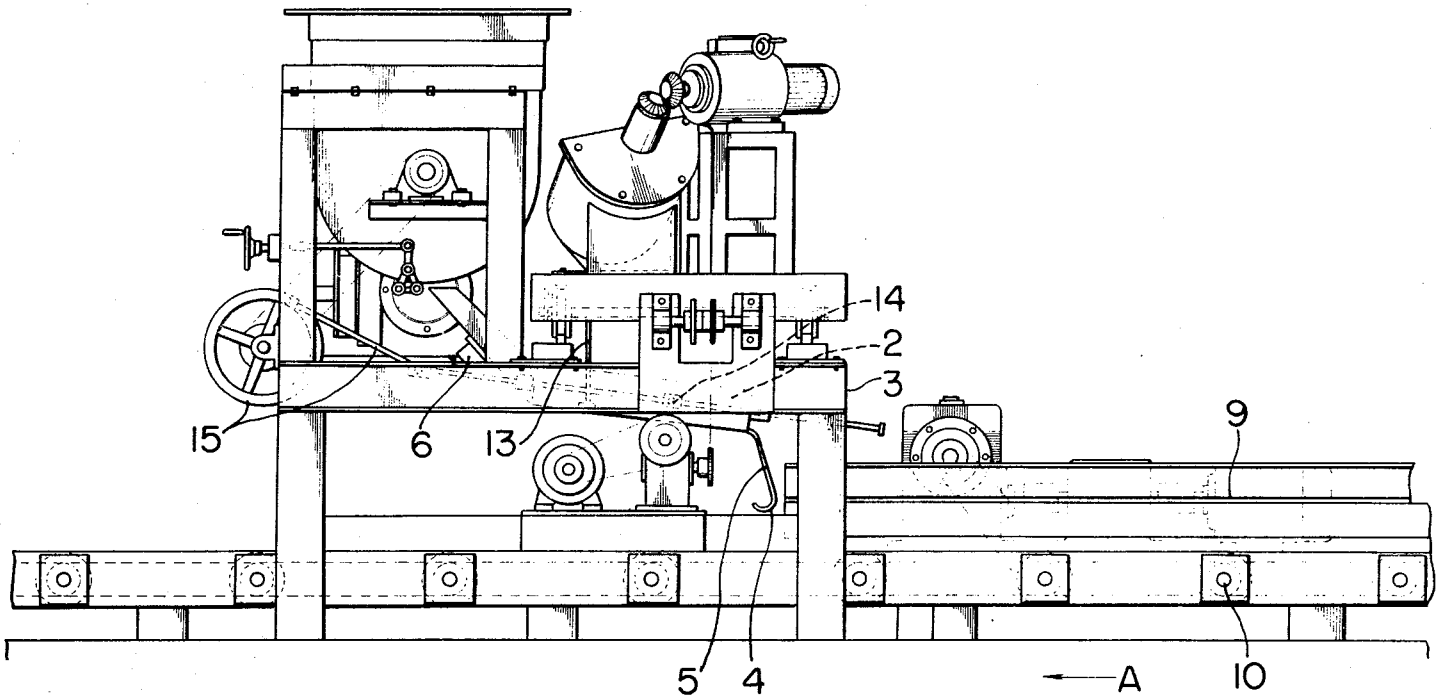

Referring to FIGS. 1 and 2, a white mortar hopper 1 is provided with an opening the width of which is equal to or a little wider than that of the concrete panel which is to be manufactured with a surface pattern provided thereon. At the lower end of the hopper 1, there is disposed a mortar shoot 2, which is suspended from a frame 3 through a vibration preventing material such as rubber or the like. A mixed mortar inverting descent guide plate 5 of a J sectional shape is disposed at the lower end of the shoot 2, the guide plate having an inverting curved portion 4 made of a flexible rubber material or the like. On the reverse side of the shoot 2, there is provided a vibrator 6 the vibrating degree of which can be adjusted to provide for adjustment of the flowing condition of the mortar.

The mortar discharged through the opening of the mortar hopper 1 flows over the shoot 2. To facilitate addition of various color mortar materials to the mortar flowing over the shoot 2, a truck 7 is arranged to be capable of making a reciprocating motion in the direction intersecting the flow of the mortar. Several units of color mortar hoppers 8 which are respectively provided with opening and closing valves are mounted on the truck 7 to enable to discharge color mortar materials onto the shoot 2 while making a reciprocating motion. With color mortar materials thus poured onto the shoot 2, the white mortar which is flowing down over the shoot 2 is incompletely mixed with such colored mortar by means of various mixing devices arranged above the shoot 2 in such a way as to draw various color patterns.

The mortar layer which is thus provided with various color patterns while flowing over the shoot 2 comes down to the guide plate portion of the shoot; and is then turned upside down at the inverting curved portion of the guide plate 2 before it is transferred onto the surface of a molding box 9. Concurrently with the transfer of the color-pattern decorated mortar layer, the molding box surface 9 is continuously moved in the direction of arrow A by means of a wheel conveyor 10, so that the color-pattern decorated mortar layer coming through the flexible inverting curved portion 4 is continuously laid on the molding box surface 9. Following this, an ordinary concrete panel can be either formed by pouring concrete or placed on the color pattern mortar layer for the mass production of concrete panels with their surfaces decorated with a uniform pattern.

The white mortar hopper and color mortar hoppers 8 are respectively equipped with stirrers 11 and 12 which serve to prevent the mortar from solidifying and also to maintain the homogeneity of the mortar.

Figure 6:
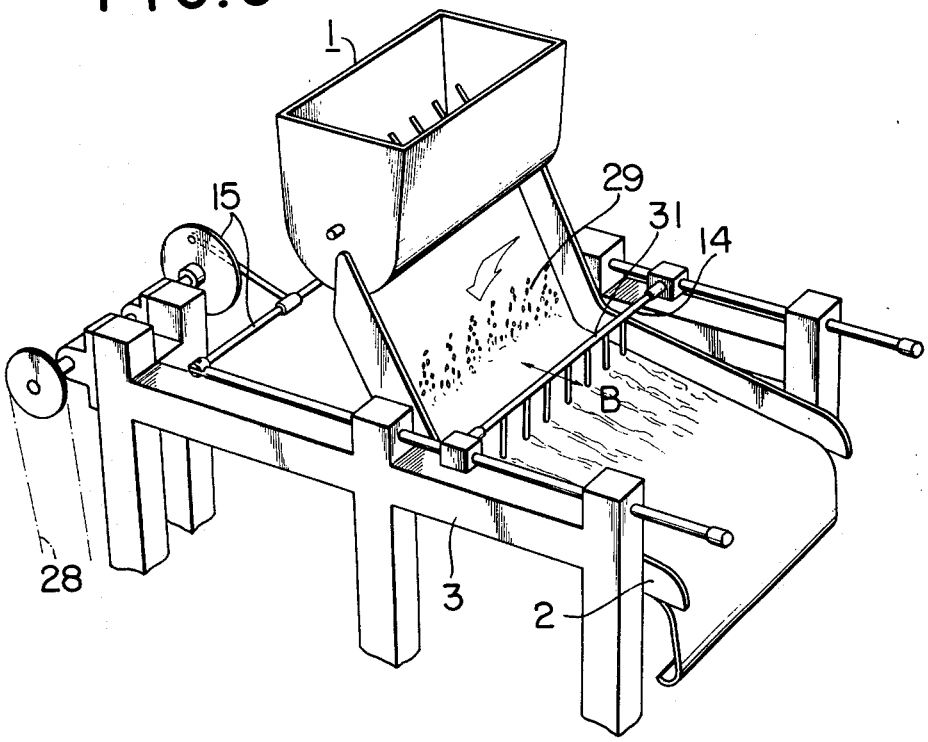
Figure 8:
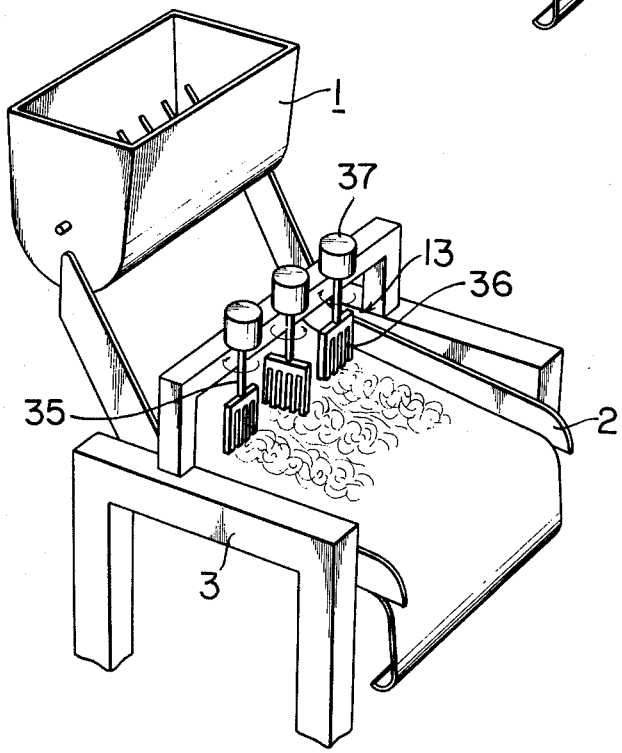

For the above-mentioned incomplete mixing of the white and color mortar materials on the shoot 2, there is provided a mixing device 13 or 14. The mixing device 13 is of a type as shown in FIG. 8; while the mixing device 14 is as shown in FIG. 6 and is driven by a crank mechanism 15.

Figure 3:
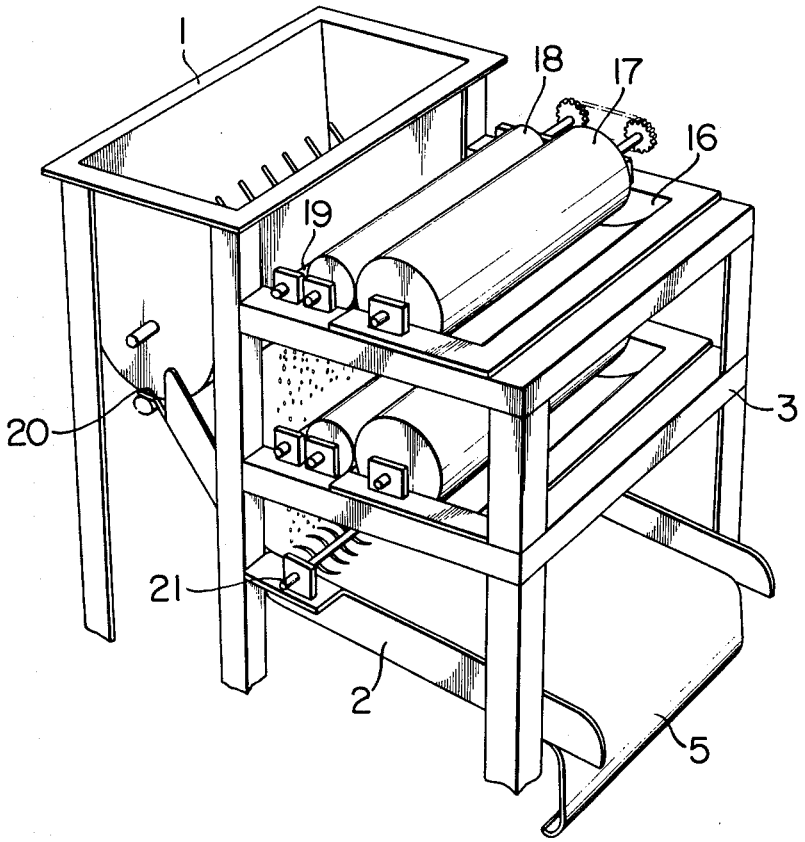
FIG. 3 is an oblique view illustrating a second embodiment.
Figure 4:
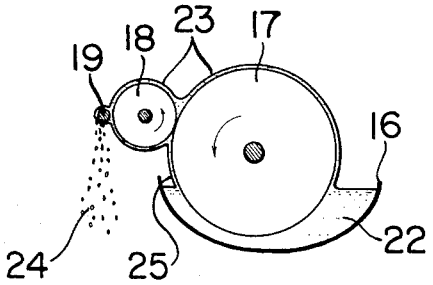
FIG. 4 is a detailed view illustrating the mechanism of the second embodiment shown in FIG. 3.

In the second embodiment, the colored mortar is discharged onto the shoot 2 in a manner different from Example 1. Referring to FIGS. 3 and 4, a scrape-up roller 17 is rotatably placed in a mortar container 16 in such a way as to scrape up the mortar inside the container. A mortar scrape-out roller 18 is disposed close to the outer circumference of the roller 17 with the spacing between the two rollers being arranged to be adjustable. With the scrape-out roller 18 rotating in the same direction as the scrape-up roller 17, the mortar scraped up by the roller 17 is scraped out by the roller 18. The amount of the mortar is adjustable by changing the rotating rate of either the roller 17 or the roller 18.

The mortar scraped out by the roller 18 is scraped down onto the shoot 2 by means of a blade or a piano wire 19 which is provided in contact with the outer circumference of the roller 18. The amount of the mortar to be scraped down to the shoot 2 is controlled by adjusting the gap between the roller 18 and the blade or piano wire 19.

A number of the color mortar containers 16 are arranged above the shoot 2 according to the number of colors required for the pattern.

The mortar remaining on the scrape-out roller 18 is returned to the container 16 through the scrape-up roller 17.

On the other hand, the white mortar is discharged to the shoot 2 through an opening 20 of the white mortar hopper 1.

Figure 5:
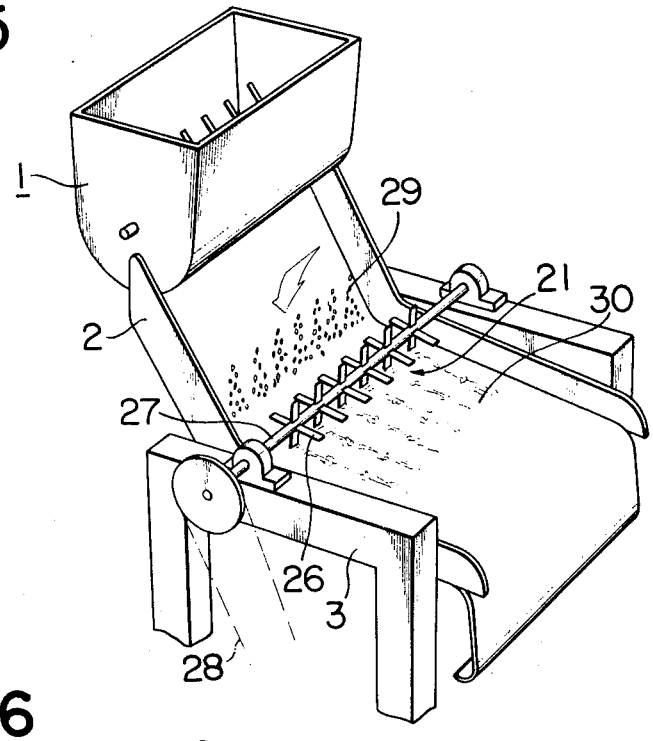
FIG. 5 through FIG. 8 are oblique views respectively illustrating, by way of examples, various mixing devices to be employed in the embodiments of this invention.

A mixing device 21 which is of the type as shown in FIG. 5 is used to mix the white mortar and the color mortar materials. The reference numeral 22 indicates the mortar which is contained in the container 16; 23 the mortar which is scraped up by the roller 17; 24 the mortar which is scraped down to the shoot 2; and 25 the mortar which is being returned to the container 16.

The details of the mixing device to be employed in practising this invention will be understood from the following description and, it goes without saying, each unit of the mixing device must be replaced with another unit every time the color is changed.

Figure 9:
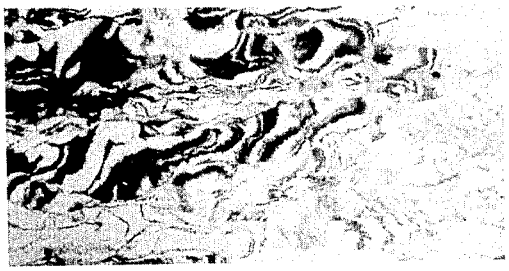
FIGS. 9, 10, 11 and 12 are photographs of the examples of surface patterns obtainable from the manufacturing apparatus of this invention.
Figure 10:
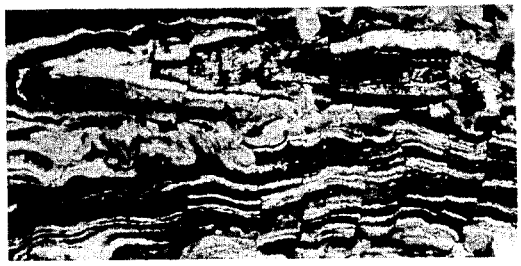
Figure 11:
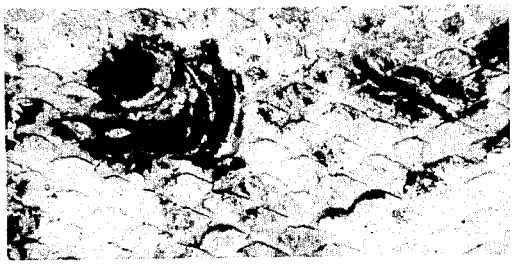
Figure 12:
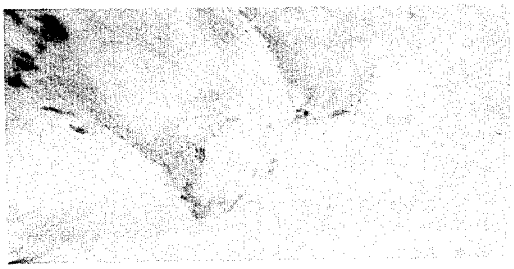

In the accompanying drawings, some examples of the surface patterns of the concrete panels obtainable from the manufacturing apparatus of this invention are represented by photographs in lieu of drawings. FIGS. 9 and 10 are photographs respectively representing concrete panels having wood grain patterns while FIGS. 11 and 12 respectively represent a concrete block.

EXAMPLE 1 OF A MIXING DEVICE

As shown in FIG. 5, the mixing device 21 includes a rotating shaft 27 which is provided with many blades 26 and is rotatably mounted over the shoot 2 across the mortar flow. The shaft 27 is driven through a belt 28 in such a manner that the white mortar coming from the hopper 1 and flowing down over the shoot 2 and the color mortar 29 separately poured onto the shoot 2 are stirred by the mixing device along the flowing direction of mortar materials to mix the two mortar materials into a mortar layer 30 having a color pattern.

EXAMPLE 2 OF A MIXING DEVICE

In the mixing device 14 shown in FIG. 6, a shaft 31 which is provided with many blades on its outer circumference is moved back and forth in the direction of arrow B by a crank mechanism 15 which is driven through a belt 28 in such a way as to stir and mix the white and color motor materials.

EXAMPLE 3 OF A MIXING DEVICE

Figure 7:
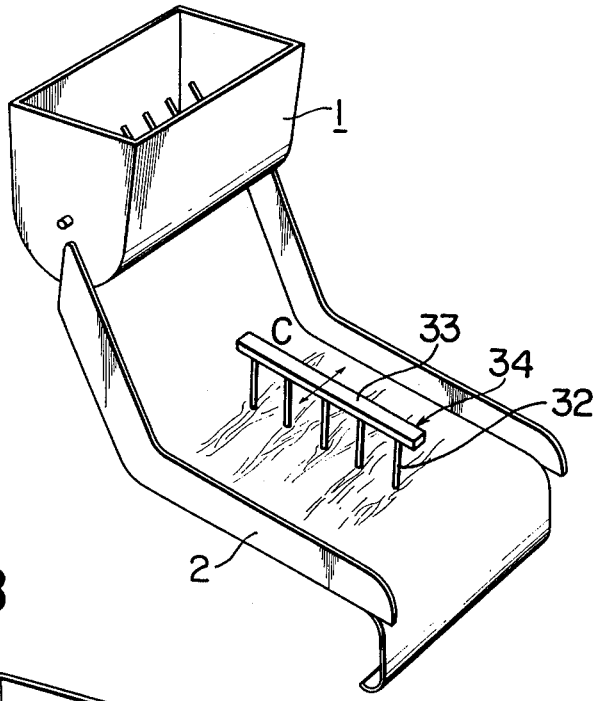

In the mixing device 34 shown in FIG. 7, a frame 33 which is provided with many blades 32 is disposed in parallel with the mortar flow. The frame 33 being mounted on an unillustrated truck, the frame is moved back and forth across the mortar flow (in the direction of arrow C) to stir and mix the two mortar materials.

EXAMPLE 4 OF A MIXING DEVICE

The mixing device 13 shown in FIG. 8 comprises a plurality of vertical rotating shafts 35 which are driven by means 37 and each having a fork-shaped blade 36, which mixes the two mortar materials by stirring them in a small circular movement. Each of these rotating shafts 35 can be arranged to have different rotating directions or rotating rates, or may be arranged to make reciprocative rotation according to desired color patterns. The blades 36 may be arranged to have a different shape. It should be understood that the invention is not limited in its application to the details of construction and arrangement of parts illustrated in the foregoing description of the preferred embodiments. Various changes and variations may be made without departing from the spirit or scope of the following claims.

I claim:

1. In an apparatus for manufacturing concrete panels with surface decoration patterns thereon, said surface decoration patterns being formed by finishing material containing color cement or pigments or other coloring material, said apparatus comprising a mortar hopper, having a mortar outlet opening, a mortar shoot extending downward from beneath the outlet opening of said hopper; a molding surface positioned below said mortar shoot, said mortar shoot extending toward said molding surface; color mortar containers disposed above the mortar shoot to discharge color mortar materials contained therein; a mixing means operatively associated with said mortar shoot for incompletely mixing the mortar with the color mortar materials on said mortar shoot; a mixed mortar inverting descent guide plate connected to the lower end of the mortar shoot; and a vibrator attached to the mortar shoot, wherein the mortar layer which is obtained with color patterns produced through the incomplete mixing carried out by said mixing means is laid on said molding surface by relative movement between said mixed mortar inverting descent guide plate and said molding surface.

2. An apparatus for manufacturing concrete panels with surface decoration patterns as defined in claim 1, wherein said color mortar containers disposed above the mortar shoot are mounted on a truck which is movable back and forth in the direction intersecting the flow of mortar on said mortar shoot.

3. An apparatus for manufacturing concrete panels with surface decoration patterns as defined in claim 1, wherein each of said color mortar containers above the mortar shoot includes a mortar scrape-up roller disposed in the color mortar container; a scrape-out roller disposed close to said scrape-up roller; and a scraping member disposed in contact with the mortar scrape-out roller to scrape down the color mortar onto said mortar shoot.

4. An apparatus for manufacturing concrete panels with surface decoration patterns as defined in claim 1, wherein said mixing means includes a plurality of rotating stirring blades.

5. An apparatus for manufacturing concrete panels with surface decorating patterns as defined in claim 1, wherein said mixing means includes a plurality of stirring blades which reciprocate in a direction perpendicular to the flow of mortar over the mortar shoot.

6. An apparatus for manufacturing concrete panels with surface decoration patterns as defined in claim 1, wherein said mixed mortar inverting descent guide plate comprises a flexible material with the lower end of which formed into a J sectional shape.

7. An apparatus for manufacturing concrete panels with surface decoration patterns as defined in claim 1, wherein said mixing means includes a plurality of reciprocating blades which reciprocate in the direction of movement of the mortar along the mortar shoot.

* * * * *